United States Patent [19]

Muggli et al.

[11] Patent Number: 4,568,919

[45] Date of Patent: Feb. 4, 1986

[54] MONITORING SYSTEM INCLUDING A NUMBER OF MEASURING STATIONS SERIES CONNECTED TO A SIGNAL LINE

[75] Inventors: Jürg Muggli, Männedorf; Peter Mueller, Oetwil am See; Hansjürg Waelti, Uetikon am See; Eugen G. Schibli, Uerikon; Max Grimm, Oetwil am See, all of Switzerland

[73] Assignee: Cerberus AG, Männedorf, Switzerland

[21] Appl. No.: 552,903

[22] Filed: Nov. 16, 1983

[30] Foreign Application Priority Data

Nov. 23, 1982 [CH] Switzerland ..... 6808/82

[51] Int. Cl.[4] ..... G08B 26/00

[52] U.S. Cl. ..... 340/518; 340/505; 340/825.54

[58] Field of Search ..... 340/518, 505, 506, 531, 340/825.29, 825.05–825.13, 825.54

[56] References Cited

U.S. PATENT DOCUMENTS

| | | | |
|---|---|---|---|
| 3,716,834 | 2/1973 | Adams | 340/505 |
| 4,161,727 | 7/1979 | Thilo et al. | 340/518 |
| 4,290,055 | 9/1981 | Furey et al. | 340/505 |
| 4,404,548 | 9/1983 | Muller et al. | 340/505 |

FOREIGN PATENT DOCUMENTS

| | | |
|---|---|---|
| 0035277 | 9/1981 | European Pat. Off. . |
| 42501 | 12/1981 | European Pat. Off. . |
| 1297008 | 6/1969 | Fed. Rep. of Germany . |
| 2533382 | 10/1976 | Fed. Rep. of Germany . |

*Primary Examiner*—Donnie L. Crosland
*Attorney, Agent, or Firm*—Werner W. Kleeman

[57] ABSTRACT

In the monitoring system which is intended for buildings, rooms and objects a multitude of measuring or detecting and signaling stations are series connected to a central signal station. Each of the detecting and signalling stations transmits information about its instantaneous state, which may be any one of standby, warning, alarm, malfunction, to the central signal station by means of an electronic circuit member. The electronic circuit member affords the following advantages: identification of the number and of the location of the detecting and signalling station in the case of changes in the state of the detecting and signalling station; detection and localization of malfunctions such as a short-circuit or an interruption in the signal line; cut-off of the short-circuited signal line section from the remaining signal line; saving of installation expense; greater flexibility in the evaluation of the states of the detecting and signalling stations and in the initiation of appropriate measures or counter-actions; operation of control devices via the signal line; monitoring of the electronic circuit member.

32 Claims, 11 Drawing Figures

MONITORING SYSTEM INCLUDING A NUMBER OF MEASURING STATIONS SERIES CONNECTED TO A SIGNAL LINE

CROSS REFERENCE TO RELATED APPLICATION

This application is related to the commonly assigned, copending U.S. application Ser. No. 06/494,966, filed Apr. 19, 1983, entitled "Method of Transmitting Measuring Values In A Monitoring Device".

BACKGROUND OF THE INVENTION

The present invention relates to a new and improved monitoring system or installation including a number of measuring or detecting and signalling stations series connected to a signal line.

In its more particular aspects the present invention relates to a new and improved monitoring system or installation including a number of measuring or detecting and signalling stations series connected to a signal line and to a central signal station including a signal processing or evaluation unit. In each of the measuring or detecting and signalling stations a series connected switching element is opened when an interrogation voltage generated by the central signal station suddenly changes to a first value and makes a through-connection to a following detecting and signalling station or control unit when the same interrogation voltage suddenly changes to a second value and after a period of time which is determined by the state of the detecting and signalling station.

The monitoring of buildings, tunnels, underground garages, rooms or other objects should optimally function to successfully fight the outbreak of a fire, the development of smoke and noxious gases or intrusion and theft. It is necessary therefore to continuously examine or check the state of the individual detecting and signalling stations and sensors, and which state, as is well known, provides information about the detecting and signalling station and the sensor and about its environment. The following states may be present: rest or standby, pre-warning or warning, alarm and malfunction. The malfunction may occur within the detecting and signalling station, in the electronic circuit member or at the signal line and is separately evaluated. The malfunction at the signal line may be a short-circuit or an interruption. Normally, a monitoring system or installation is also used for monitoring large buildings containing many different rooms and objects. In such case a multitude of detecting and signalling stations or sensors is employed for accomplishing different monitoring tasks. Different types of detecting and signalling stations or detectors may be used, such as ionization detectors, optical smoke detectors, heat, radiation, gas and intrusion detectors and they can be combined in one monitoring system. Such different types of detecting and signalling stations or detectors have different response behavior. In a monitoring system as known, for example, from German Pat. No. 2,533,382, published Oct. 21, 1976, regrettably the different types of detecting and signalling stations must be integrated in the monitoring system by using separate evaluation means and at an increased expense of the system.

A method of identifying detecting and signalling stations or detectors within a fire detecting system is known, for example, from European Pat. No. 0,042,501, published Dec. 30, 1981. The direction of interrogation of a relevant signal line is reversed when a malfunction occurs.

In a method of identifying the detecting and signalling stations or detectors in a monitoring system as described in the initially mentioned cross-referenced U.S. application Ser. No. 06/494,966, filed Apr. 19, 1983, entitled "Method Of Transmitting Measuring Values In A Monitoring Device", each detecting and signalling station or detector has an address store which is provided with an address which is characteristic for the corresponding detecting and signalling station.

The methods as described in the aforementioned European Patent and the cross-referenced U.S. patent application have the disadvantage of great expense and the impossibility of being able to retrofit existing monitoring systems. Furthermore, short-circuits cannot be detected and the system is inoperative in the event that such malfunction occurs.

SUMMARY OF THE INVENTION

Therefore, with the foregoing in mind it is a primary object of the present invention to provide a new and improved monitoring system or installation including a number of detecting and signalling stations or detectors series connected to a signal line, wherein detecting and signalling stations or detectors or sensors of different types can be operated using the same signal line.

Another important object of the present invention is directed to the provision of a new and improved monitoring system or installation including a number of detecting and signalling stations which are series connected to a signal line in which ionization detectors or sensors, optical smoke detectors or sensors, heat detectors or sensors, radiation detectors or sensors, gas detectors or sensors and intrusion detectors or sensors can be employed using the same signal line.

Still a further significant object of the present invention is directed to a new and improved construction of a monitoring system or installation including a number of detecting and signalling stations or detectors which are series connected in a signal line in which fire alarm keys and control units can be connected to the same signal line as the detecting and signalling stations.

Another, important object of the present invention is directed to a new and improved construction of a monitoring system or installation including a number of detecting and signalling stations which are series connected to a signal line which comprises elements which can be readily installed in order to modify existing monitoring systems without any great expense.

Still another important object of the present invention is directed to a new and improved construction of a monitoring system or installation including a number of detecting and signalling stations which are series connected in a signal line which even can be operated when only a part of the detecting and signalling stations are installed therein.

Now in order to implement these and still further objects of the invention, which will become more readily apparent as the description procedes, the monitoring system of the present development is manifested by the features that, there is provided an electronic circuit member or section which generates electrical signals at time intervals which are characteristic for the state of the relevant detecting and signalling station and these electrical signals are transmitted to the signal processing unit which evaluates the electrical signals only within predetermined periods of time for monitoring the electronic circuit member or section.

In the monitoring system according to the invention each detecting and signalling station or sensor decides as such upon the state which it assumes, such as standby, warning, alarm, malfunction. In this manner the different types of detecting and signalling stations or sensors can be connected to one signal line or the central signal station without causing any adaptation problems. Thus existent monitoring systems can be modernized without any great expense. When the electronic circuit member or circuit is installed in the socket member of the detecting and signalling station or detector, the electronic circuit members or circuits and the central signal stations form a complete monitoring and transmission system. This has the great advantage that a system can be set in operation even when only a part of the number of detecting and signalling stations or detectors has been installed, so that section-wise operation, conversion or retrofitting and inspection of the monitoring system are possible.

The electronic circuit member or circuit in the detecting and signalling stations of the monitoring system according to the invention permits the transmission of all of the signals, i.e. of information signals transmitted from the detecting and signalling stations to the central signal station as well as control signals in reverse direction, using only one pair of conductors. Due to the drastic reduction from, for example, three or more conductors or lines as conventionally used in the prior art to two conductors or lines, the conductors and the entire inventive monitoring system are much less prone to malfunction.

Instead of only one also a number of detectors or sensors can be connected to the electronic circuit member in the detecting and signalling station of the monitoring system according to the invention. This is advantageous when a number of detectors or sensors are placed in the same room. Irrespective of which particular detector or sensor responds, it is only this room which is subject to the generation of detection signals. Simultaneously with the assumption of an alarm state, each detecting and signalling station energizes the alarm indicator associated therewith which, for example, may be a light-emitting diode.

The electronic circuit member or circuit in the detecting and signalling station of the inventive monitoring system also serves to detect a short-circuit in a direction of the next series connected detecting and signalling station. The site of the short-circuit can be precisely located, and thus, the malfunction can be rapidly and readily removed. In spite of the short-circuit the full operational voltage is maintained at the entire signal line. Only that portion of the signal line where the short-circuit exists will be turned-off. This has the advantage that, despite the short-circuit, the interrogation cycle of the individual detecting and signalling stations or sensors is further carried out and a change in the states thereof is immediately recognized.

The electrical signals corresponding to the states of the detecting and signalling stations are evaluated in the central signal station only within predetermined periods of time. The intermediate time intervals are defined as "malfunction bands". Signals which occur within the malfunction bands, then, will signal a corresponding malfunction at the central signal station.

The monitoring system according to the invention, furthermore, permits those electrical signals which are transmitted by the central signal station to fight an alarm which has been recognized and indicated by one or a number of detecting and signalling stations, to be sent via the same conductors or lines. Contrary thereto, such signals are transmitted on separate additional conductors or lines in the prior art systems. Therefore, a very great amount of conductor or line material is saved when using the inventive monitoring system.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
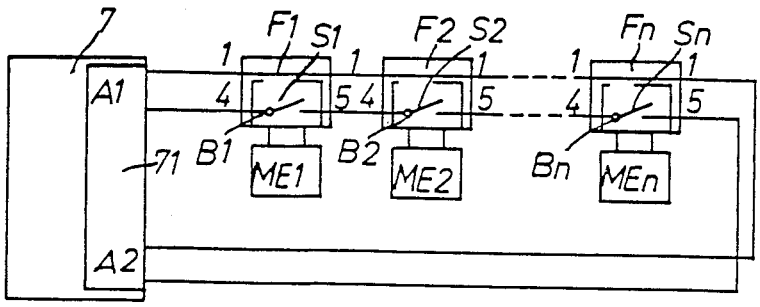
FIG. 1 is a schematic block circuit diagram of a first embodiment of monitoring system constructed according to the invention.

Describing now the drawings, it is to be understood that only enough of the construction of the inventive monitoring systems has been shown as needed for those skilled in the art to readily understand the underlying principles and concepts of the present development, while simplifying the showing of the drawings. Turning attention now specifically to FIG. 1, there has been schematically illustrated therein a first exemplary embodiment of the inventive monitoring system or installation which comprises a central signal station 7. The individual detecting and signalling stations or detectors which include socket members F1, F2, . . . Fn and detector inserts ME1, ME2, . . . MEn are connected to the central signal station 7 via signal lines or conductors 1, 4, 5. The detector inserts ME1, ME2, . . . MEn can be designed as ionization, heat, radiation, gas, intrusion and as optical smoke detecting inserts. The detecting and signalling stations are series connected to the signal line 1 and the further signal line 4, 5 and the signal lines 1, 4, 5, in turn, are connected to and form a closed loop with the terminals A1 and A2 of the central signal station 7 and the signal processing unit or evaluation device 71. In the first embodiment as shown in FIG. 1, the electronic circuit member or circuit of each detecting and signalling station is arranged within a respective socket member F1, F2, . . . Fn. At least one detector insert ME1, ME2, . . . MEn is provided at each socket member F1, F2, . . . Fn. To facilitate inspection of such FIG. 1, only the switching elements S1, S2, Sn and the electronic circuit members or circuits B1, B2, Bn are shown which are incorporated in the socket members F1, F2, Fn, respectively.

After interrogation of a detecting and signalling station by the central signal station 7, the switching element of such detecting and signalling station closes and connects the central signal station 7 to a further series connected detecting and signalling station which is then interrogated. In this manner all the detecting and signalling stations are individually and sequentially interrogated. The signals which characterize the state of the detecting and signalling stations are evaluated in the signal processing unit 71. As soon as a detecting and signalling station signals an unusual state such as, for example, non-readiness, warning, alarm, malfunction (short-circuit, interruption) of the detecting and signalling station, of the electronic circuit member or of the signal line, the same will be, for instance, acoustically and optically indicated or permanently recorded and appropriate countermeasures are initiated by the central signal station 7. Such is generally known and does not constitute the subject of the invention and, therefore, is not addressed here in any particular detail.

Figure 8:
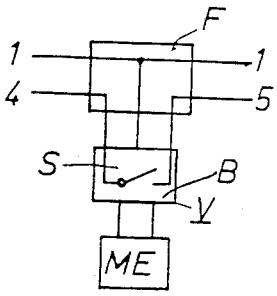
FIG. 8 is a block circuit diagram of a detecting and signalling station in a fourth embodiment of the monitoring system according to the invention in which the electronic circuit member and the switching element are placed in a connecting member between a socket member and a detector insert of the detecting and signalling station.
Figure 9:
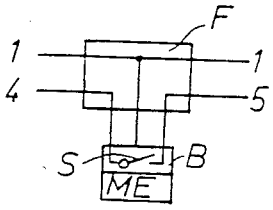
FIG. 9 shows a block circuit diagram of a detecting and signalling station in a fifth embodiment of the monitoring system according to the invention in which the switching element and the electronic circuit member are incorporated in a detector insert of the detecting and signalling station.

The electronic circuit members B can also be placed in an arrangement which differs from that as shown in FIG. 1. For example, namely in the embodiment of the monitoring system according to the invention, as shown in FIG. 9, the electronic circuit member B is incorporated in the detector insert ME. In another embodiment, namely the embodiment of the inventive monitoring system which is shown in FIG. 8, a connecting member V is installed between the detector insert ME and the socket member F, and the switching element S and the electronic circuit member B can be incorporated in the connecting member V. In the event that existent monitoring systems are intended to be modernized, this can be done fairly readily since in the monitoring system according to the invention the switching element S and the electronic circuit member B can be placed either in the socket member F, in the detector insert ME or in the connecting member V.

Figure 2:
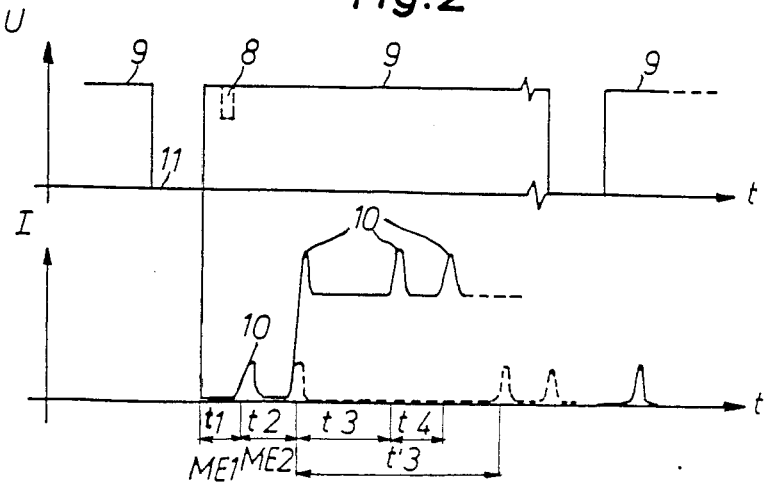
FIG. 2 is a schematic diagram showing the changes of voltage and current with time in the monitoring system depicted in FIG. 1 when operated in a first mode of an interrogation cycle.

In the following the invention will be explained with reference to FIGS. 2 to 4. In its upper portion FIG. 2 shows the variation of the interrogation voltage with time and two steps of the interrogation voltage will be recognized. The time is plotted along the abscissa and the voltage V appearing on the lines 1, 4 of the monitoring system illustrated in FIG. 1 is plotted along the ordinate. Within the interrogation cycle there appears a control voltage which will be explained later with reference to FIG. 6. This control voltage forms a control pulse 8 which is depicted in dashed lines and may be used for resetting a detecting and signalling station which has been placed in an alarm state. This has the advantage that detecting and signalling stations, after having triggered the alarm, are again reset into their normal inactive state of readiness or standby, either individually or differently in accordance with the type or nature of the detecting and signalling stations. The interrogation voltage V, as shown in FIG. 2, is generated by the central signal station 7 and is inputted to the conductors or lines, i.e. to the signal line. One step 11 of the voltage U, for example, is at zero volts; the other step of the interrogation voltage 9 may amount to, for example, 20 volts. The voltage pattern as shown is supplied to the line or conductor leading to the detecting and signalling stations in distinct time intervals. During each interval which may encompass, for example, 1 to 2 seconds all the detecting and signalling stations are interrogated. The detecting and signalling stations sequentially signal their state to the central signal station 7. This is shown in the lower portion of FIG. 2. Here the time t is plotted along the abscissa and the current I conducted by the signal line is plotted along the ordinate. It will be recognized that the effect of the interrogation voltage 9 is that the switch S1 present in the socket member F1 of the first detecting and signalling station will be closed after a distinct period of time t1 and that the electronic circuit member B1 generates a current pulse 10 of distinct amplitude and length. The time t1 is representative for the signal processing unit 71 that the detecting and signalling station comprising the socket member F1 and the detector insert ME1 are in their normal inactive state of functional readiness or standby.

The same state is assumed to be present at the next series connected detecting and signalling station comprising the socket member F2 and the detector insert ME2. The time interval t2, therefore, is equal to t1. It may now be assumed that the third detecting and signalling station is in a state of alarm. As soon as the switching element S2 of the aforementioned preceding detecting and signalling station makes the through-connection to the third detecting and signalling station, the current amplitude suddenly changes to a high value which is caused by the additional current flowing through an alarm indicator L1 (see FIG. 4). Furthermore, the time interval t3 which spans the time interval between the moment of time when the third detecting and signalling station is connected to the moment of time when a through-connection or conductive path is established from the third to the fourth detecting and signalling stations, is substantially longer than the so-called "normal" time periods or intervals t1 and t2. The two criteria, namely the current amplitude and the length of the time interval, which characterize the alarm state of the third detecting and signalling station, are recognized in the signal processing unit 71. The central signal station 7, then, will initiate the correspondingly required measures. The fourth detecting and signalling station is assumed to be again in its normal inactive state of operational readiness or standby. This will be indicated by the fact that the time interval t4, which extends from the moment of time when the fourth detecting and signalling station is connected to the moment of time when the switching element S4 in the fourth detecting and signalling station makes the through-connection, is in the normal range.

The states of the detecting and signalling stations also can be indicated and signalled to the signal processing unit 71 by only one criterium, i.e. either by the current amplitude or by the length of the time interval; also different current amplitudes, but having the same time intervals can be used as criteria to indicate and signal the state of the detecting and signalling station to the signal processing unit 71.

In the bottom portion of FIG. 2 there is assumed a state of malfunction for the third detecting and signalling station as a further example. While the two preceding detecting and signalling stations comprising the socket members F1 and F2 and the detector inserts ME1 and ME2, respectively, are in the inactive state characterized by the identical time intervals t1 and t2, the time interval t'3 is much longer. Such increased length of the time interval will be evaluated by the signal processing unit 71 to indicate a malfunction at the third detecting and signalling station. Corresponding measures will be initiated by the central signal station 7. For the purpose of better differentiation, this second example is shown in dashed lines in FIG. 2. The further series connected detecting and signalling stations, again, have the normal inactive state of operational readiness or standby. In the case that a detecting and signalling station is in a state of malfunction, the alarm indicator L1 is not activated and, therefore, the current variation illustrated by dashed lines in FIG. 2 does not show a sudden change in the current amplitude when the through-connection is made from the switching element S2 of the second detecting and signalling station.

Due to the high current amplitude the transmission of an alarm state to the central signal station 7 is extremely reliable. Also, identification of the detecting and signalling station which is in the alarm state would be very useful. Such could be achieved by associating each detecting and signalling station with a respective individual number or address, whereby, the exact location of an event becomes immediately known. Thus, the address and the state of the detecting and signalling station could be transmitted to the central signal station 7, for example, using digital techniques. However, such a system is very expensive and prone to malfunction. Furthermore, it is difficult to install because a specific number has to be allocated to each individual detecting and signalling station. In the case of a single error possibly the entire monitoring system may no longer function. In the inventive monitoring system as described herein, however, addressing of the individual detecting and signalling stations, and thus, the problems connected therewith are eliminated. Quite to the contrary, numbering and identification of the detecting and signalling stations is effected by counting the current pulses 10 at the central signal station 7 during each interrogation cycle.

To complete the explanation of FIG. 2 it is further noted that the time intervals between the individual current pulses 10 can be arranged such that the shortest time interval corresponds to the normal inactive state of operational readiness or standby, that a medium length time interval corresponds to the alarm state and the longest time interval is provided for indicating a state of malfunction. The time interval characterizing the state of warning either can have the same length as the time interval indicating a malfunction or may differ therefrom. It is also readily possible that the shortest time interval corresponds to the state of alarm and a medium length time interval is provided for the normal inactive state of operational readiness or standby, and the longest time interval is provided to indicate a malfunction. Also in this case the time interval indicating a warning state either can have the same length as that indicating a malfunction or may be different therefrom. All such possible combinations can be provided as required in each case.

Figure 4:
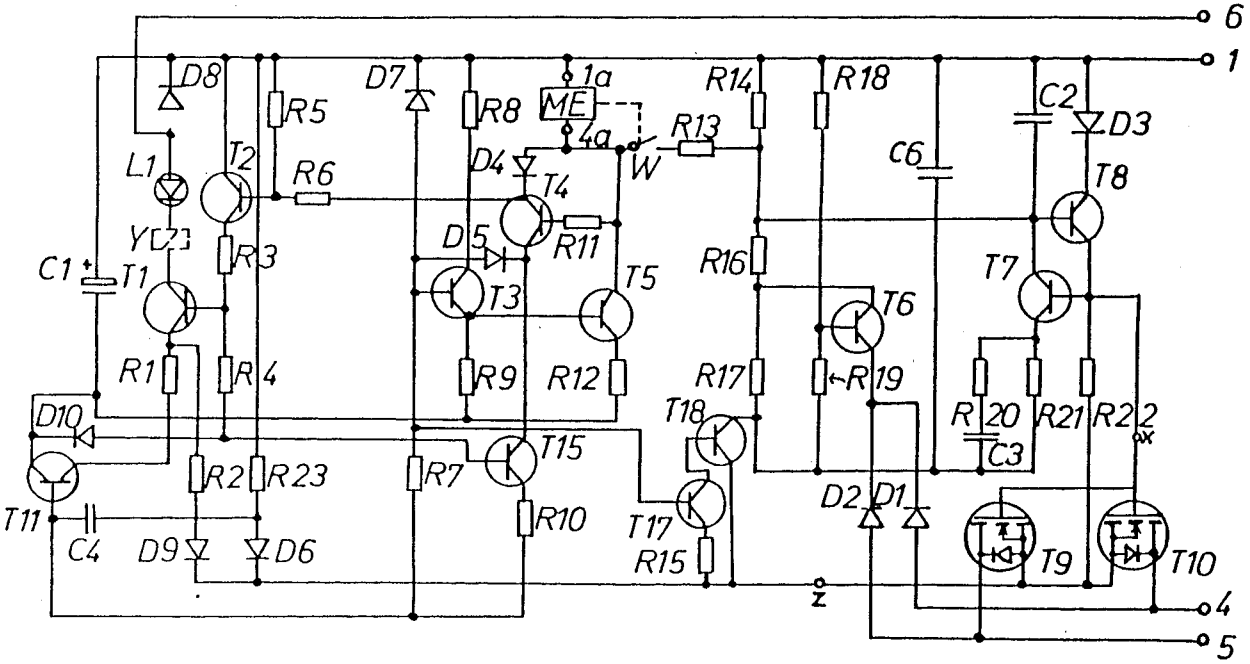
FIG. 4 is a detailed circuit diagram of an electronic circuit member or circuit in a detecting and signalling station of the monitoring system shown in FIG. 1.

A schematic circuit diagram of the electronic circuit member B used in the different detecting and signalling stations of the first embodiment of the monitoring system according to the invention is shown in FIG. 4. The interrogation voltage U generated by the central signal station 7 is present at the terminals of the conductors or lines 1 and 4. The detector insert ME is connected to the electronic circuit member B as shown in the upper portion at the center of FIG. 4. A distinct voltage or current value present at the terminals 1*a* and 4*a* of the electronic circuit member B corresponds to a respective state of the detector insert ME. When the detector insert ME is connected to the electronic circuit member B, the switch W is closed. The switch W is opened when the detector insert ME is removed.

To explain the mode of operation of the electronic circuit member B it may be assumed that the system is at its normal operational level. During the currentless time, i.e. at the voltage step 11 of the interrogation cycle (see FIG. 2), the capacitor C1 supplies power to the entire circuitry including the detector insert ME. The collector-base path of transistor T11 is forward biased and a current flowing across the resistor R7 generates a stable voltage at the Zener diode D7. In conjunction with resistor R8 the transistor T3 acts as a constant current source, the current of which is mirrored by the resistors R9, R12 and the transistor T5. Thus, a limited current is available to supply power to the detector insert ME at the terminal 4*a*. The transistors T1, T2, T4, T6, T7, T8, T9, T10, T15, T17, and T18 are non-conductive or blocked and the capacitor C6 is discharged. The switching element S is formed by two field-effect transistors T9 and T10 and is blocked by the resistor R22 during the time period when the detecting and signalling station assumes the aforementioned state.

Now when the line voltage at terminal 4 increases to the interrogation voltage 9, the point "z" is at the same increased voltage or potential because of the action of the diode integrated in the transistor T10. When this occurs, at first the voltage at the capacitor C6 rises to the Zener voltage of the zener diode D7 via the resistor R15 and the transistors T17 and T18. The voltage divider formed by the resistors R13 to R17 is dimensioned such that the capacitor C2 is charged until the diode D3 and the transistor T8 are conductive. The charging of the capacitor C2, in particular, is effected at different rates, depending upon the voltage at the detector insert ME or at the terminal 4a respectively. With a high voltage appearing at the terminal 4a, which corresponds to the inactive state of the detecting and signalling station, the charging time is $T_R$; when, for example, the detector insert ME is absent, no current is conducted through resistor R13, since the switch W is opened and the charging time for the capacitor C2 is relatively long and corresponds to a time period $T_S$. When the detecting and signalling station is in a state of alarm, the voltage at the terminal 4a assumes a medium voltage value which will result in a medium charging time $T_A$, so that $T_R$ is smaller than $T_A$ and the latter, in turn, is smaller than $T_S$. When the transistor T8 is cut-in, transistor T7 also will be conductive and the current pulse 10 is generated which is determined by the capacitor C3 and the resistor R20 and which is registered by the signal processing unit 71 of the central signal station 7. The transistors T7, T8 are maintained in their conductive state by the resistor R21 which also serves to discharge the capacitor C3 when the line voltage again drops back to zero at a later time. The transistors T9, T10 are F.E.T.'s i.e. field-effect transistors and the gates thereof are controlled by the transistor T8 in such a way that the two field-effect transistors T9, T10 make a through-connection to the following series connected detecting and signalling station via terminal 5 as soon as the flip-flop formed by the two transistors T7, T8 is conductive. It will be clear that the "pistons" of the field-effect transistors T9 and T10 can be exchanged depending on whether terminals 4 and 5 form the input and the output or the output and the input, respectively. The capacitor C6 will maintain the voltage across the resistors R14 to R17 during the brief voltage decrease due to the control pulse as shown in FIG. 2.

The network comprising the diodes D1, D2, the transistor T6 and the resistors R18, R19 serves to check the following conductor section between terminals 1 and 5 for short-circuits. The transistor T6 acts like an emitter-follower charging the section in question approximately to the voltage provided by the voltage divider formed by the resistors R18 and R19 which are connected to the base of the transistor T6. In the event that a short-circuit exists, the transistor T6 continuously remains in the conductive state and maintains the voltage between the resistors R16 and R17 at such a low value that the capacitor C2 cannot be charged to the turn-on voltage of the transistor T8. Thus, no current pulse 10 can be formed in the case of a short-circuit. In the case of a short-circuit also the two field-effect transistors T9 and T10 remain opened and block the conductance to the following detecting and signalling station and separate the short-circuit from the central signal station 7. In such case the signal processing unit 71 will not receive a current pulse 10 for a longer period of time. The central signal station 7 now re-switches the next-following interrogation cycle to the lines 1 and 5. The direction of interrogation of the detecting and signalling stations is thus reversed. It is essential that, despite the presence of a short-circuit, the detecting and signalling stations can be interrogated without disturbance.

When the line voltage suddenly changes from the zero voltage step or null value 11 to the interrogation voltage 9, the voltage at the capacitor C4 is raised by the same amount to negative voltage via the diode D6. During this change the base of the transistor T11 also becomes negatively charged to such an extent that the transistor T11 is blocked. The capacitor C4 now is discharged via the current circuit formed by the resistor R7 and the diode D7, by the resistor R23 and by the resistor 10 and the transistor T15. As long as the transistor T11 blocks, the capacitor C1 cannot be recharged and this is for a delay time Tv. During this delay time Tv, however, the transistor T15 is conductive and the collector current flows via the diode D5 and the diode D7 in case that the detector insert ME is in the inactive state at which a high voltage exists at the terminal 4a; otherwise the current flows via the transistor T4, the diode D4 and the detector insert ME and the transistor T4 and the resistors R6, R5. When the voltage at the detector insert ME assumes a medium voltage value corresponding to an alarm state of the detecting and signalling station, then the transistor T2 is cut-in via the resistors R6, R5 and the transistor T1 is rendered conductive, i.e. the alarm indicator L1 flashes and optically and directly indicates the alarm state at the detecting and signalling station. Between the connection terminals 1 and 6 there may also be connected a separate indicator. The required voltage is formed via the Zener diode D8. Such external indicator is illuminated synchronously with the alarm indicator L1. In the case that the detector insert ME is in a state of malfunction, the voltage at the resistors R5, R6 is insufficient to activate the transistor T1, so that the alarm indicator L1 is not illuminated in the case of malfunction. The relay Y shown in dashed lines indicates that external loads also can be switched by the alarm indicator pulse. The current for the alarm indicator L1 partially is derived from the signal line via the diode D9 and the resistor R2 and partially from the storage capacitor C1 via the diode D10 and the resistor R1. The proportion derived via the resistor R2 produces the large current increase which occurs when a detecting and signalling station is in the alarm state as shown after the time interval t2 in FIG. 2 and which is reliably detected as an alarm criterion by the central signal station 71. The voltage divider R3, R4 blocks further current drain from the storage capacitor C1 when the voltage thereof has dropped to too low a value. This is required because the capacitor C1 represents a voltage supply source which may not be too extensively discharged. It will be clear that the transistor T1 no longer conducts when the capacitor C4 is discharged to such an extent that the transistor T15 blocks. At this moment of time the transistor T11 switches to its conductive state and the capacitor C1 is recharged via the diode D9, the resistors R2 and R1 and the transistor T11. The interrogation cycle is completed when the line voltage again drops again to the zero voltage step or level 11.

Figure 3:
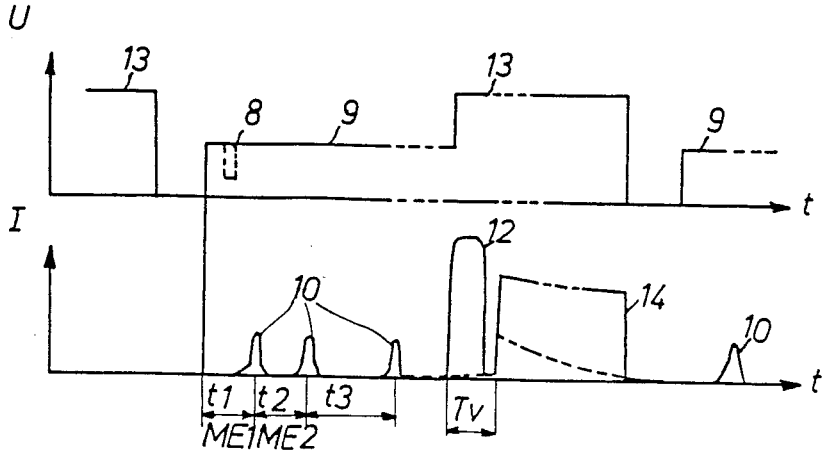
FIG. 3 is a schematic diagram showing the changes in voltage and current with time in the monitoring system depicted in FIG. 1 when operated in a second mode of an interrogation cycle.

A second embodiment of the monitoring system according to the invention is operated using an interrogation cycle as illustrated in FIG. 3 of the drawings which can also be realized using the electronic circuit member B as illustrated by the detailed circuit diagram of FIG. 4. In the upper portion of FIG. 3 there is plotted the time t along the abscissa and the interrogation voltage U appearing on the signal lines 1 and 4 or 5 is plotted along the ordinate. The upper portion of FIG. 3 shows the interrogation voltage 9 which is followed by an increased voltage 13. This increased voltage 13 is intended to support the capacitor C1 shown in FIG. 4. In case that a large number of detecting and signalling stations are connected to the signal line 1, 4 or 1, 5 and are interrogated, then the capacitors C1 in the last detecting and signalling stations MEn, MEn-1 in the sequence of the series connected detecting and signalling stations are relatively extensively discharged. By employing the increased voltage 13 all the capacitors C1 can be sufficiently recharged. In such case the circuit as illustrated in FIG. 4 must be dimensioned such and the interrogation voltage 9 must be selected such that, while the different time intervals t are formed and the switching elements S formed by the field-effect transistors make the through-connections, the recharging of the storage capacitors C1 is only activated by the increased voltage 13. Furthermore, the alarm indicator L1, which is formed by a luminescent diode, will only be illuminated at a detecting and signalling station in the alarm state after the interrogation at the interrogation voltage 9 has been completed. There are thus avoided disturbances and faulty information which may occur during the interrogation cycle due to the increase in current caused by the illumination of the luminescent diode. In fact, all of the luminescent or light-emitting diodes are now illuminated at a moment of time at which otherwise there flow only small currents. This will result in a very high reliability for the entire monitoring system. A control pulse 8 is also shown in FIG. 3 of the drawings, however, will be explained in greater detail later with reference to FIG. 6. The control pulse 8 which is shown in dashed lines is also used for resetting a detector insert which is in the alarm state. The advantage resulting therefrom is that the detecting and signalling stations, after having triggered an alarm, are reset into their normal inactive state of operational readiness or standby, either individually or differently depending upon the type or nature of the detecting and signalling station.

In the bottom portion of FIG. 3 there are shown the current pulses 10 of the individual detecting and signalling stations as well as the current caused by the increased voltage 13. The time t is plotted along the abscissa and the current I appearing on the signal line is plotted along the ordinate. As shown by the interrogation cycle, the first two detecting and signalling stations are again in their inactive state, since the time intervals t1 and t2 of the current pulses 10 are in the normal range. The third detecting and signalling station is in the alarm state, since the time interval t3 between the current pulses 10 is longer than the other two time intervals. After the interrogation cycle the luminescent diode associated with this detecting and signalling station is illuminated. This is illustrated by an increased current amplitude 12. The capacitor C1 shown in FIG. 4 also is sufficiently charged and can fully take over the current supply to the related detecting and signalling station. This is illustrated by the increased current amplitude 14. The charging of the capacitor C1 is delayed by a time period Tv, so that the current variation caused by the luminescent diode can be reliably detected as an alarm criterion by the signal processing unit 71. This is shown in the lower portion of FIG. 3. The following interrogation cycle will start after a certain length of time.

Figure 5:
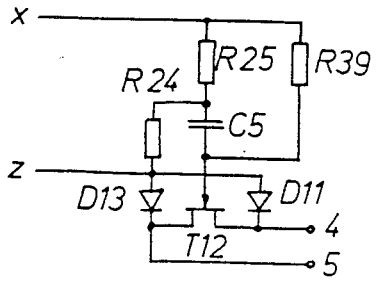
FIG. 5 is a circuit diagram of an electronic circuit member in a detecting and signalling station according to a second embodiment of the monitoring system according to the invention.

A third embodiment of the monitoring system according to the invention comprises a different switching element S which is shown in FIG. 5. In the electronic circuit member or circuit B as shown in FIG. 4 this modified switching element S is connected to the points x, z, 4 and 5 in the lower right-hand portion of FIG. 4. The circuit as shown in FIG. 5 constitutes a junction field-effect transistor (JFET) circuit which replaces the two field-effect transistors T9 and T10 shown in FIG. 4. The capacitor C5 in the modified switching element S shown in FIG. 5 stores the gate-biasing voltage to safely block the junction field-effect transistor T12 during the zero voltage step 11. The resistors R24, R25, and R39 adjust for the correct level of d.c.-voltage at the gate of the junction field-effect transistor T12. The diodes D11, D13, perform the same function as the diodes integrated in the field-effect transistors T9 and T10 shown in FIG. 4.

In a fourth embodiment of the monitoring system according to the invention a control unit or receiving circuit is employed and can also be used in such a way that the control units are selectively installed at the same signal lines 1, 4 and 5 (see FIG. 1) as the detecting and signalling stations. Such control units perform control functions to initiate countermeasures in the case of an alarm or a malfunction. It may be stressed in this respect that only such a number of control units can be exchanged for detecting and signalling stations as required for the organization of the monitoring system. Due to the freedom of exchange between the detecting and signalling stations and the control units, existing monitoring systems can be reorganized without effort to also include control functions. Thus, not only indicating signals are transmitted from the detecting and signalling stations to the central signal station 7 via the lines 1, 4 and 5, but also the control pulses 8 shown in FIGS. 2 and 3 are transmitted from the central signal station to the control units via the receiving circuit as illustrated in FIG. 6 via the signal lines 1, 4 and 5.

Figure 6:
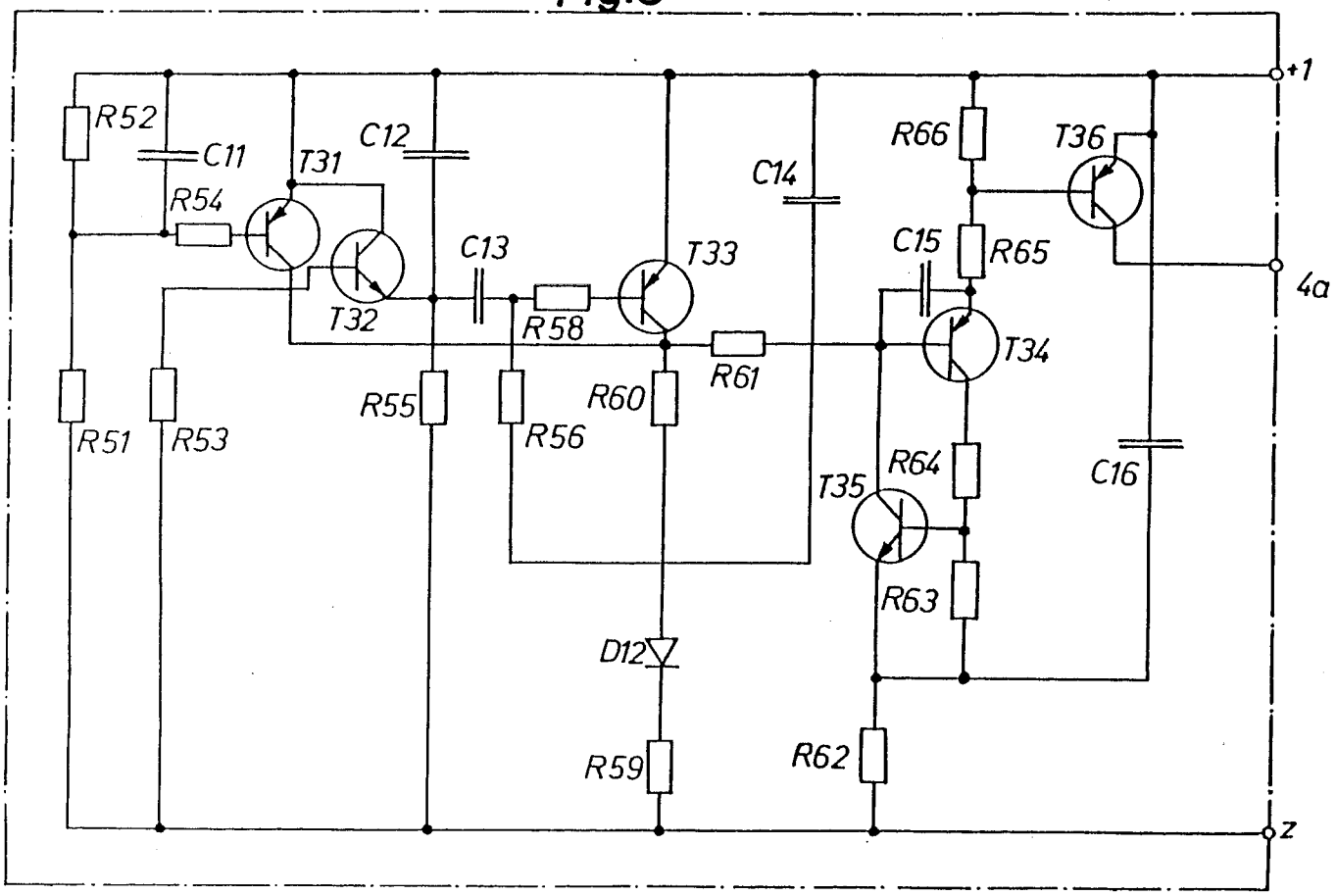
FIG. 6 is a schematic circuit diagram of a control unit or circuit for generating a control function in the detecting and signalling station of the monitoring system shown in FIG. 1.

A preferred receiving circuit for the control pulses 8 as illustrated in FIG. 6 is connected to the electronic circuit member B as shown in FIG. 4 at the terminals or points "+1" and "z". Preferably, the output of the receiving circuit is connected to the terminal 4*a* of the electronic circuit member B of the related detecting and signalling station. On receipt of a control pulse 8 the output transistor T36 of the receiver circuit is rendered conductive and then causes a long time interval $T_S$ at the related electronic circuit member or section B of the relevant detecting and signalling station. The central signal station 7 thus receives a notice or receipt that the control pulse 8 has been correctly received. In such arrangement the receiving circuit as illustrated by the circuit diagram of FIG. 6 generates an output signal to specifically reset the detector insert ME which is connected to the same electronic circuit member and which previously has been set into the alarm state. It will be self-evident that the receiving circuit, as illustrated by the circuit diagram of FIG. 6, can also be employed to trigger the most varied functions, in particular to also control relays for fighting conditions of danger. In such arrangement, a separate control unit comprising a socket member into which the electronic circuit member B as shown in FIG. 4 and the control pulse receiving circuit as shown in FIG. 6 are incorporated and which is not provided with a detector insert ME, is installed in the signal line 1, 4, 5 in place of a detecting and signalling station. In the prior art separate conductors or lines were used for the control functions. The fourth embodiment of the monitoring system as described herein thus substantially saves on installation materials.

For better understanding the mode of operation of the receiving circuit illustrated by the circuit diagram of FIG. 6, it may be assumed that the storage capacitor C14 is charged to its normal operating voltage via the diode D12 and the resistors R59, R60. The instantaneous voltage at "z" is assumed to be zero and thus corresponds to the zero voltage step 11 in the interrogation cycle as illustrated in FIGS. 2 and 3. While the transistor T33 is conductive because the base thereof is controlled by resistors R56 and R58, the transistor T34 is nonconductive because it is blocked via the resistor R61. Thus, the transistors T35 and T36 also are in their non-conductive state. The capacitor C11 has been discharged via the resistors R51 and R52 to such an extent that the transistor T31 is blocked. As long as there is zero voltage at "z", the transistor T32 also will be blocked. The capacitor C12 is discharged via the resistor R55 and a voltage is applied to the capacitor C13 which is governed by the voltage divider R56 and R58.

As soon as the interrogation voltage 9 is present at the detecting and signalling station, the capacitor C11 is charged via the resistor R51 and the transistor T31 becomes conductive after a certain delay time. During such delay time, the transistor T32 remains in its blocked state. The voltage at the capacitor C12 rapidly rises and during this time the capacitor C13 also is rapidly charged to a large proportion of this voltage. When a control pulse 8 is transmitted from the central signal station 7, the voltage at "z" is changed, the transistor T32 acts as an emitter follower and the voltage at the capacitor C12 rapidly decreases to the voltage of the control pulse 8, while the voltage at the capacitor C13 can vary only slowly due to the high valued resistors R56, R58. Consequently, the voltage at the junction or node of the resistors R56, R58 and of the capacitor C13 becomes positive to such an extent that the transistor T33 is blocked. When the transistor T33 is blocked, the flip-flop stage formed by the transistors T34 and T35 is rendered conductive via the transistor T34 from the resistors R60, R61. Correspondingly the output transistor T36 also switches through. The timing element formed by the resistor R62 and the capacitor C16 substantially serves to maintain the supply voltage at the flip-flop stage also throughout the duration of the control pulse 8 during which the voltage at the point "z" may drop to zero. By means of the resistors R63 to R66 and the capacitor C15 the security against disturbances is increased. It will be evident that the control pulse 8 can only cut-in the flip-flop stage formed by the two transistors T34 and T35 as long as the transistor T31 is blocked, i.e. the control pulse 8 must be present during the time-delay which is formed by the capacitor C11 and by the resistors R51, R52. At all other times the control pulse 8 will be ineffective. This is extremely important to enable selective control of the individual detecting and signalling stations by the central signal station 7 and the occurrence of the control pulse 8 is "clocked" in appropriate manner to the occurrence of the current pulse 10. As illustrated in FIGS. 2 and 3, the detecting and signalling station in the third position from the central signal station 7 is in the alarm state and will be reset by the control pulse 8 which occurs in the next following interrogation cycle after the interrogation voltage 9 is applied to the same station.

For completeness it may be mentioned that by a slight modification of the receiving circuit illustrated by FIG. 6, it is possible, for example, for a number of control pulses which occur in rapid succession to be received and counted in order to selectively trigger different functions which, for example, depend on the number of control pulses. In the same way also other characteristics of the control pulses which are conventional in telecontrol and which may constitute, for example, the width, the height or the frequency of the pulses, may be used for differentiated triggering of control functions.

Figure 7:
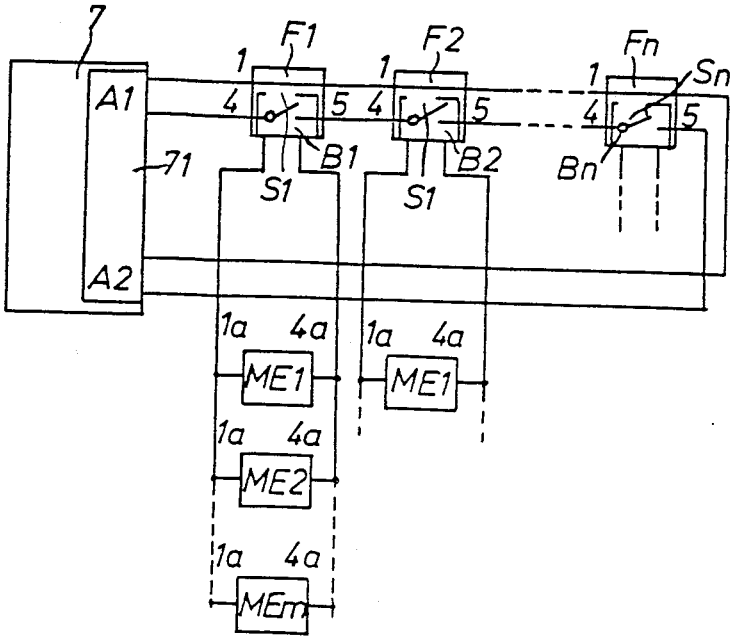
FIG. 7 shows a schematic block circuit diagram of a third embodiment of the monitoring system according to the invention in which a number of detector inserts are connected to one detecting and signalling station.

A fourth embodiment of the monitoring system according to the invention is shown in FIG. 7. Here a number of detector inserts ME1, ME2, . . . MEm are connected in parallel to the terminals 1*a* and 4*a* (see FIG. 4) of a socket member F1 and may also be connected to the socket members F2 to Fn. The socket members F1, F2, . . . Fn, in turn, are series connected to the central signal station 7 including the signal processing unit 71. In the socket member F there is arranged the electronic circuit member B as illustrated in FIG. 4 or the modified electronic circuit member including the modified switching element as illustrated in FIG. 5. This is indicated by the switching elements S1, S2, . . . Sn. The mode of operation is the same as in the first embodiment illustrated by FIG. 1 of the drawings. It will be self-evident, however, that now the states of the individual detector inserts ME which are connected in parallel to the terminals 1*a* and 4*a* are no longer individually known. Since the detector inserts ME connect widely differing impedances via the terminals 1*a* and 4*a* in the states of inactivity, warning, alarm or malfunction, respectively, the socket member F or detecting and signalling station practically will detect the state of the detector insert which has the lowest impedance. This state is then signalled to the central signal station 7 via the electronic circuit member B which is incorporated in the socket member F. FIG. 7 is intended to illustrate the possible variety in the arrangement of the detector inserts ME at the different detecting and signalling stations.

The fifth embodiment of the monitoring system according to the invention shown in FIG. 8 includes a connecting member V installed between the detector insert ME and the socket member F in each detecting and signalling station, and the switching element S and the electronic circuit member B are incorporated in the connecting member V. This is specifically required for monitoring systems which are intended to be modernized while keeping the existing sockets and the existent run or layout of the conductors.

A sixth embodiment of the monitoring system according to the invention is shown in FIG. 9. Here the electronic circuit member B which has the circuit configuration as illustrated by FIG. 4, is installed together with the switching element S and the detector insert ME at the socket member F. Such detecting and signalling stations can be readily installed in already existent monitoring systems.

Figure 10:
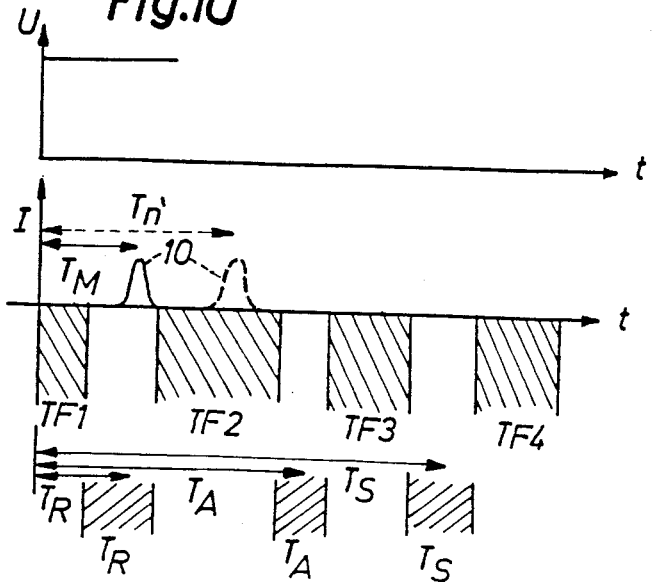
FIG. 10 is a schematic diagram showing the evaluation of the periods of time during operation of the detecting and signalling stations including malfunction bands in a signal processing unit of the monitoring system as shown in FIG. 1.

In the illustration of FIG. 10 there is explained in which way the ranged covering the characteristic time intervals of the detecting and signalling stations which are utilized in the signal processing unit 71 are subdivided into positive and negative regions. At the moment of time t=0 an electronic circuit member B of a detecting and signalling station may be connected to the interrogation voltage 9. After a specified time $T_n$ or $T'_n$ there is generated the current pulse 10. In case that the detected time $T_n$ or $T'_n$ which correspond to a respective one of the time intervals t1, t2, t3, t4 and t'3 as shown in FIGS. 2 and 3, are within a positive range, which is the range indicated by $T_R$, $T_A$ and $T_S$, a decision is made depending upon whether the detecting and signalling station is in a state of operational readiness or standby state, in a warning state, in an alarm state or in a malfunction state. In case that the time $T_n$ or $T'_n$ is outside the tolerance range, i.e. within the forbidden negative ranges as indicated by TF1, TF2, TF3 and TF4, a conclusion is selectively possible as concerns a malfunction in the electronic circuit member B as, for example, caused by a component whose manufacturing tolerance is outside the tolerance limits, or because of a disturbing effect in the signal line 1, 4, 5 which, for example, may be predicated upon an electromagnetic disturbance. The signal processing unit 71 contains a microprocessor which, for example, can be of the commercially available type Motorola MC 6809 and which compares the time intervals t1, t2, t3, t'3, and t4 which characterize the state of the detecting and signalling station and of the conductors to the positive and negative time ranges stored therein in accordance with a predetermined program. Not only are the detecting and signalling stations as shown in FIGS. 1, 7, 8 and 9 and the control unit as shown in FIG. 6, but also the electronic circuit member B as illustrated in FIGS. 4 and 5 and all the conductors or lines extending between the detecting and signalling stations, the control units and the central signal station 7 are permanently monitored. The reliability of transmission is thereby substantially improved.

Figure 11:
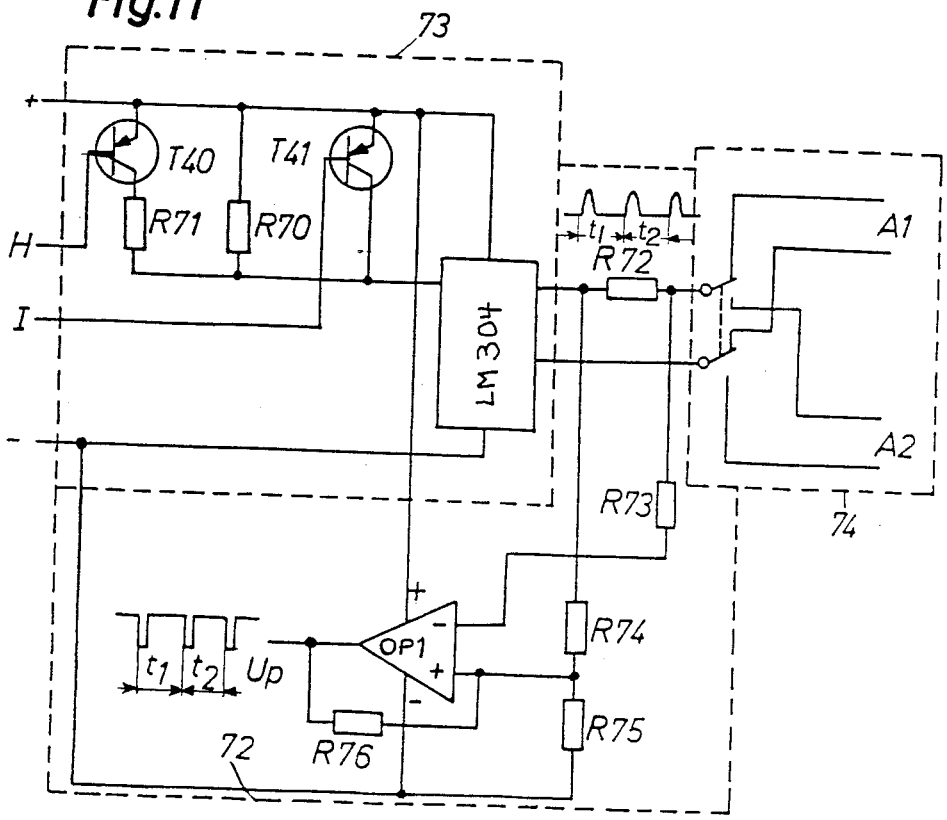
FIG. 11 is a schematic circuit diagram showing a simple central station and signal processing unit of a sixth embodiment of the monitoring system according to the invention.

In FIG. 11 there is shown a block circuit diagram of a simple design of the central signal station 7 including the signal processing unit 71. The microprocessor assumes all of the required controlling and monitoring functions. The figure of the drawing is subdivided in order to depict a control circuit 73 for the voltage, a current evaluation circuit 72 as well as a line switching circuit 74. The line voltage is realized via a programming input of an integrated circuit like, for example, LM304 which constitutes a voltage regulator. When the transistor T41 is activated via the output I of the microprocessor, the line voltage is zero. When neither the transistor T41 nor the transistor T40 are activated or rendered conductive, then the increased voltage 13 (see FIG. 3) is adjusted by means of the resistor R70. When the transistor T40 is activated via the line or conductor marked H, then the resistors R70 and R71 are connected in parallel to each other. In this way the interrogation voltage as shown in FIGS. 2 and 3 is generated.

The current is measured in known manner via an operational amplifier OP1 which is connected as a comparator by means of the resistors R72 to R76. The output Up of the operational amplifier OP1 is connected to one input of the microprocessor. The microprocessor now can measure the time intervals t1, t2 and so forth and associates the same to one of the "time windows" marked $T_R$, $T_A$, $T_S$ and TF1 to TF4 as shown in FIG. 10. In this way the specific state of each individual detecting and signalling station can be determined.

In the upper right-hand portion of FIG. 11 there is furthermore shown a switching or reswitching circuit 74 which serves, by means of a relay, to interrogate the signal line either from the front terminal A1 or from the rear terminal A2 in the central signal station 7. This is very useful in those cases in which a short-circuit or interruption has occurred on the signal line.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A monitoring system comprising:

a number of detecting and signalling stations series-connected in a signal line and capable of assuming at least three distinct states;

a central signal station generating an interrogation voltage and including a signal processing unit;

said central signal station being operatively connected to said detecting and signalling stations;

each said detecting and signalling station including a switching element adapted to be opened by a sudden change in said interrogation voltage to a first value and to be closed by a sudden change in said interrogation voltage to a second value;

each said detecting and signalling station being provided with an electronic circuit member for generating, at distinct time intervals, electrical signals which are, in combination with said distinct time intervals, characteristic of each one of said at least three distinct states of said detecting and signalling station and for transmitting said electrical signals to said signal processing unit;

said signal processing unit processing said electrical signals only within predetermined periods of time for monitoring said electronic circuit member; and each said switching element in a respective detecting and signalling station a through-connection to a further series connected detecting and signalling station after a predetermined period of time which is determined by said state of said deteching and signalling station.

2. The monitoring system as defined in claim 1, further including:

a number of control units replacing predetermined ones of said detecting and signalling stations.

3. The monitoring system as defined in claim 1, further including:

a further signal line series-connecting in a closed loop said central signal station and said switching elements of said number of detecting and signalling stations;

each said switching element of each said detecting and signalling being connected with said further signal line on a first side which is situated closer to said central signal station and on a second side which is situated more remote from said central signal station; and means for selectively connecting said central signal station with said detecting and signalling stations either via said first or via said second side of the related switching element.

4. The monitoring system as defined in claim 1, wherein:

a first one of said at least three different states corresponds to an inactive state of said detecting and signalling station;

a second one of said at least three different states corresponds to an alarm state of said detecting and signalling station; and a third one of said at least three different states corresponds to a malfunction state of said detecting and signalling station.

5. The monitoring system as defined in claim 4, wherein:

each said detecting and signalling station is structured to assume said three different states and a further different state; and said electronic circuit member transmitting to said signal processing unit a further electrical signal characteristic for said further different state at a distinct time interval.

6. The monitoring system as defined in claim 5, wherein:

said further time interval characteristic for said further different state is identical to a time interval characteristic for a selective one of said three states.

7. The monitoring system as defined in claim 6, wherein:

said further different state corresponds to a warning state and said selective state corresponds to said malfunction state.

8. The monitoring system as defined in claim 5, wherein:

said further time interval characteristic for said further different state is different from said time intervals characteristic for said three different states.

9. The monitoring system as defined in claim 8, wherein:

said further different state corresponds to a warning state.

10. The monitoring system as defined in claim 1, wherein:

said electrical signals generated by said electronic circuit member occur at distinct time intervals and have distinct amplitudes; and each distinct amplitude and each distinct time interval being characteristic of a respective one of said different states of said detecting and signalling station.

11. The monitoring system as defined in claim 1, wherein:

said electrical signals are generated by said electronic circuit member at distinct time intervals, each one of which is characteristic of a respective one of said different states of said detecting and signalling station.

12. The monitoring system as defined in claim 1, wherein:

said electrical signals generated by said electronic circuit member have distinct amplitudes and occur at the same distinct time intervals; and each said distinct amplitude being characteristic of a respective one of said different states of said detecting and signalling stations.

13. The monitoring system as defined in claim 1, wherein:

said electrical signals generated by said electronic circuit member form pulses of distinct width, each of which is characteristic of a respective one of said different states of said detecting and signalling station.

14. The monitoring system as defined in claim 4, wherein:

each said detecting and signalling station further includes an alarm indicator; and each said detecting and signalling station, when responding to said interrogation voltage and when in said alarm state, switching on said alarm indicator only in the presence of a predetermined change in voltage on said signal line.

15. The monitoring system as defined in claim 14, wherein:

said interrogation voltage generated by said central signal station assumes a further value within a distinct time period;

said alarm indicator, when activated, causing an increased current flow; and said increased current flow being signalled to said signal processing unit only within said distinct time period during which said interrogation voltage assumes said further value.

16. The monitoring system as defined in claim 15, wherein:

each said detecting and signalling station comprises a detector insert assuming and determining said distinct states of said detecting and signalling station;

said electronic circuit member comprises a capacitor forming a current supply of said electronic circuit member and said detector insert and which is charged at a predetermined moment of time;

said alarm indicator forming a luminescent indicator which is illuminated for a predetermined period of time; and said electronic circuit member further comprising a circuit component for separating, during said alarm state of said detector insert, said illuminated period of said alarm indicator and the period during which said increased current flow is conducted at said signal line by a predetermined period of time from said predetermined moment of time at which said capacitor is charged.

17. The monitoring system as defined in claim 16, wherein:

said capacitor is charged with a time-delay provided that said alarm indicator is in a non-luminescent state.

18. The monitoring system as defined in claim 1, wherein:

said electronic circuit member comprises a detector circuit component for detecting a short-circuit in a line leading to the electronic circuit member in said further series connected detecting and signalling station and for blocking said through-connection to the latter.

19. The monitoring system as defined in claim 1, wherein:

one said electronic circuit member is provided for a number of said detector inserts.

20. The monitoring system as defined in claim 1, wherein:

said switching element in said detecting and signalling station being constituted by one field-effect transistor in said electronic circuit member.

21. The monitoring system as defined in claim 1, wherein:

said switching element in said detecting and signalling station is constituted by two field-effect transistors in said electronic circuit member.

22. The monitoring system as defined in claim 1, further including:

a relay for triggering countermeasures when an alarm or malfunction is signalled to said central signal station;

said central signal station comprising means for generating a control pulse;

said control pulse being generated during such time when said interrogation voltage is applied to said electronic circuit member in one of said detecting and signalling stations and prior to making a through-connection to said further series connected detecting and signalling station by said switching element; and said electronic circuit member detecting said control pulse and recognizing the same as a command for activating said relay.

23. The monitoring system as defined in claim 1, wherein:

said central signal station comprises means for generating a control pulse;

said control pulse being generated during such time when said interrogation voltage is applied to said electronic circuit member in one of said detecting and signalling stations and prior to making a through-connection to said further series connected detecting and signalling station by said switching element; and said control pulse setting said detecting and signalling station into one of said distinct states.

24. The monitoring system as defined in claim 1, wherein:

said distinct states of said detecting and signalling stations include an alarm state;

said central signal station comprising means for generating a control pulse; and said control pulse being generated during such time when said interrogation voltage is applied to said electronic circuit member in one of said detecting and signalling stations and prior to making a through-connection to said further series connected detecting and signalling station by said switching element and resetting said detecting and signalling station from said alarm state.

25. The monitoring system as defined in claim 2, further including:

means for generating a preprogrammed sequence of control pulses; and said preprogrammed sequence of control pulses triggering distinct control functions during interrogation of said detecting and signalling stations.

26. The monitoring system as defined in claim 1, wherein:

said detecting and signalling station comprises a socket member; and said electronic circuit member being incorporated in said socket member.

27. The monitoring system as defined in claim 1, wherein:

said detecting and signalling station comprises a connecting member; and said electronic circuit member being incorporated in said connecting member.

28. The monitoring system as defined in claim 14, wherein:

said signal line comprises two supply lines;

said electronic circuit member comprises a switching circuit component connected between said two supply lines;

said alarm indicator comprising a luminescent diode; and said switching circuit component energizing said luminescent diode.

29. The monitoring system as defined in claim 22, wherein:

said signal line comprises two supply lines; and said electronic circuit member comprises a switching circuit component connected between said two supply lines and serving to energize said relay for triggering counter measures in the event that an alarm or malfunction is signalled.

30. The monitoring system as defined in claim 14, further including:

a relay for triggering countermeasures in the event that an alarm or malfunction is signalled to said central station;

said alarm indicator comprising a luminescent diode;

said signal line comprising two supply lines;

said electronic circuit member comprising a switching circuit component connected between said two supply lines; and said switching circuit component energizing said luminescent diode and said relay.

31. A monitoring system comprising:

a number of detecting and signalling stations series-connected in a signal line and capable of assuming at least three distinct states;

a central signal station generating an interrogation voltage and including a signal processing unit;

said central signal station being operatively connected to said detecting and signalling stations;

each said detecting and signalling station including a switching element adapted to be opened by a sudden change in said interrogation voltage to a first value and to be closed by a sudden change in said interrogation voltage to a second value;

each said detecting and signalling station being provided with an electronic circuit member for generating, at distinct time intervals, electrical signals which are, in combination with said distinct time intervals, characteristic of each one osai at least three distinct states of said detecting and signalling station and for transmitting said electrical signals to said signal processing unit;

said signal processing unit containing means for setting a first sequence of time ranges within a predetermined tolerance range, each of which time ranges of said first sequence is related to one of said distinct time intervals, and a second sequence of time ranges outside said predetermined tolerance range, each of which time ranges of said second sequence is related to one of said distinct time intervals;

said signal processing unit further containing means for associating each said electrical signal generated by the electronic circuit member of a related one of said number of detecting and signalling stations, with a related one of said time ranges of said first sequence and of said second sequence of time ranges in order to identify the associated one of said at least three distinct states of said related detecting and signalling station; and each said swtiching element in a respective detecting and signalling station making a through-connection to a further series-connected detecting and signalling station after a predetermined period of time which is determined by said state of said detecting and signalling station.

32. A monitoring system comprising:

a number of detecting and signalling stations series-connected in a signal line and capable of assuming at least three distinct states;

a central signal station generating an interrogation voltage and including a signal processing unit;

said central signal station generating a control pulse at predetermined moments of time;

said central signal station being operatively connected to said detecting and signalling stations;

each said detecting and signalling station including a switching element adapted to be opened by a sudden change in said interrogation voltage to a first value and to be closed by a sudden change in said interrogation voltage to a second value;

said central signal station generating said control pulse at said predetermined moment of time after said change of said interrogation voltage to said second value of said interrogation voltage;

each said detecting and signalling station being provided with an electronic circuit member for generating, at distinct time intervals, electrical signals which are, in combination with said distinct time intervals, characteristic of each one of said at least three distinct states of said detecting and signalling station, and for transmitting said electrical signals to said signal processing unit;

a predetermined number of control pulse receiving circuits;

each one of said control pulse receiving circuits being connected to said signal line and being operatively connected to said electronic circuit member of a related one of said number of detecting and singalling stations in order to trigger at least one preselected control function following a predetermined one of said at least three distinct states of said related detecting and signalling station;

said signal processing unit containing means for setting a first sequence of time ranges within a predetermined tolerance range, each of which time ranges of said first sequence is related to one of said distinct time intervals, and a second sequence of time ranges outside said predetermined tolerance range, each of which time ranges of said second sequence is related to one of said distinct time intervals;

said signal processing unit further containing means for associating each said electrical signal generated by the electronic circuit member of a related one of said number of detecting and signalling stations, with a related one of said time ranges in said first sequence and in said second sequence of tiem ranges in order to identify the associated one of said at least three distanct states of said related detecting and signalling station; and each said switching element in a respective detecting and signalling station making a through-connection to a further series-connected detecting and signalling station after a predetermined period of time which is determined by said state of said detecting and signalling station.

* * * * *

UNITED STATES PATENT AND TRADEMARK OFFICE

CERTIFICATE OF CORRECTION

PATENT NO. : 4,568,919

DATED : February 4, 1986

INVENTOR(S) : Jürg Muggli et al

It is certified that error appears in the above—identified patent and that said Letters Patent is hereby corrected as shown below:

In the Abstract, line 3, delete "signaling" and insert --signalling--

Column 2, line 61, delete "procedes" and insert --proceeds--

Column 16, line 28, delete "deteching" and insert --detecting--

Column 16, line 41, after "signalling" insert --station--

Column 20, line 30, delete "osai" and insert --of said--

Column 20, line 53, delete "swtiching" and insert --switching--

Column 21, lines 25 and 26, delete "singall" and "ing" and insert --signalling--

Column 22, line 17, delete "tiem" and insert --time--

Column 22, line 19, delete "distanct" and insert --distinct--

Signed and Sealed this

*Third* Day of *June 1986*

[SEAL]

*Attest:*

DONALD J. QUIGG

*Attesting Officer*

*Commissioner of Patents and Trademarks*